US008511108B2

(12) United States Patent
Yabu et al.

(10) Patent No.: US 8,511,108 B2
(45) Date of Patent: Aug. 20, 2013

(54) AIR CONDITIONING UNIT

(75) Inventors: Tomohiro Yabu, Sakai (JP); Tetsuya Morizane, Sakai (JP); Kaichi Tsuji, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 842 days.

(21) Appl. No.: 12/297,422

(22) PCT Filed: Apr. 18, 2007

(86) PCT No.: PCT/JP2007/058410

§ 371 (c)(1), (2), (4) Date: Oct. 16, 2008

(87) PCT Pub. No.: WO2007/123146

PCT Pub. Date: Nov. 1, 2007

(65) Prior Publication Data

US 2009/0095008 A1 Apr. 16, 2009

(30) Foreign Application Priority Data

Apr. 21, 2006 (JP) ..... 2006-117447

(51) Int. Cl.

| | |
|---|---|
| ***F25D 17/06*** | (2006.01) |
| ***F24D 5/10*** | (2006.01) |
| ***F24D 19/02*** | (2006.01) |
| ***F24H 9/06*** | (2006.01) |
| ***F24H 3/02*** | (2006.01) |

(52) U.S. Cl.

USPC ..... 62/426; 165/53; 165/55; 165/56; 165/57

(58) Field of Classification Search

USPC ..... 62/426, 259.2, 262, 298, 313, 247, 62/245, 248; 165/53, 55, 56, 57; 454/233

See application file for complete search history.

(56) References Cited

U.S. PATENT DOCUMENTS

| | | | | |
|---|---|---|---|---|
| 4,170,880 | A * | 10/1979 | Lou | 62/262 |
| 5,577,958 | A * | 11/1996 | Kumekawa et al. | 454/233 |
| 5,888,133 | A * | 3/1999 | Mori et al. | 454/318 |

(Continued)

FOREIGN PATENT DOCUMENTS

| | | | |
|---|---|---|---|
| EP | 0 950 867 | A2 | 10/1999 |
| EP | 1 188 993 | A1 | 3/2002 |
| EP | 1 319 900 | A1 | 6/2003 |
| EP | 1482252 | A2 | 1/2004 |
| EP | 1 621 823 | A2 | 2/2006 |
| JP | 61-10427 | U | 1/1986 |
| JP | 07-158955 | A | 6/1995 |
| JP | 07-158956 | A | 6/1995 |
| JP | 09210402 | A * | 8/1997 |
| JP | 2006-029665 | A | 2/2006 |
| JP | 2006-029665 | A | 2/2006 |

OTHER PUBLICATIONS

European Search Report of corresponding EP Application No. 07 74 1846.5 dated Nov. 7, 2011.

*Primary Examiner* — Judy Swann
*Assistant Examiner* — Ian Soule
(74) *Attorney, Agent, or Firm* — Global IP Counselors

(57) ABSTRACT

An air conditioning unit has improved visual appeal in a non-operational state, and can reduce smudging of a ceiling in an air conditioned space by discharged air. The air conditioning unit is configured to be disposed above a space to be air-conditioned. The air conditioning unit includes a case, a first moveable panel, and a moveable panel actuating mechanism. The case has at least one discharge duct on a bottom face. The first moveable panel is configured to open and close the discharge duct. The moveable panel actuating mechanism moves the first moveable panels between a first position at which at least the outside section of the discharge duct is closed off, and a second position at which the outside section of the discharge duct is opened.

11 Claims, 10 Drawing Sheets

(56) References Cited

U.S. PATENT DOCUMENTS 6,093,097 A * 7/2000 Cho ..... 454/233
6,250,373 B1 * 6/2001 Vecchi et al. ..... 165/53
6,264,552 B1 * 7/2001 Oya et al. ..... 454/304
6,450,880 B1 * 9/2002 Asahina et al. ..... 454/233
7,000,688 B2 * 2/2006 Horttanainen et al. ..... 165/123
2004/0237572 A1 * 12/2004 Lee et al. ..... 62/419

* cited by examiner

AIR CONDITIONING UNIT

CROSS-REFERENCE TO RELATED APPLICATIONS

This U.S. National stage application claims priority under 35 U.S.C. §119(a) to Japanese Patent Application No. 2006-117447, filed in Japan on Apr. 21, 2006, the entire contents of which are hereby incorporated herein by reference.

TECHNICAL FIELD

The present invention relates to an air conditioning unit, and relates in particular to an air conditioning unit to be disposed above an air-conditioned space.

BACKGROUND ART

Air conditioning units embedded into a ceiling, in which a bottom face of a case is flat so that an air discharge duct and air intake duct will follow the ceiling, have conventionally been known as air conditioning units to be disposed above an air-conditioned space.

According to such a ceiling-embedded air conditioning unit, indoor air is drawn in through the air intake duct on the bottom face of the case; the air drawn in is either cooled or heated by a heat exchanger inside the case to produce conditioned air; and the conditioned air after produced is then discharged back into the room through the air discharge duct on the bottom face of the case.

SUMMARY OF THE INVENTION

Problems the Invention Attempts to Solve

However, with air conditioning units such as those of a ceiling-embedded design, the air discharge duct located on the bottom face of the case is visible from within the room; therefore, it has been difficult to improve visual appeal.

Moreover, since the air discharge duct on the bottom face of the case is situated in proximity to the ceiling surface, there has been a risk that some of the conditioned air discharged from the air discharge duct might be directed onto the ceiling surface, possibly smudging the ceiling.

An object of the present invention is to provide an air conditioning unit that has improved visual appeal in a non-operational state, and that affords reduced smudging of the ceiling of the air conditioned space by discharged air.

Means for Solving the Problem

The air conditioning unit according to a first aspect is an air conditioning unit to be disposed above a space to be air conditioned. The air conditioning unit includes a case; first moveable panels; and a moveable panel actuating mechanism. The case has at least one discharge duct on a bottom face. The first moveable panels open and close the discharge duct. The moveable panel actuating mechanism moves the first moveable panels between a first position for closing off at least the outside section of the discharge duct, and a second position opened to the outside of the discharge duct.

According to this aspect, when the air conditioning unit is not in operation, in the first position, the first moveable panel will close off at least the outside section of the discharge duct so as to conceal it from view from inside the air-conditioned space, thereby improving the visual appeal of the air conditioning unit in the non-operational state. Meanwhile, when the air conditioning unit is running, the first moveable panel will move to the second position at which the discharge duct is open to the outside, thus making it possible to reduce smudging of the ceiling of the air-conditioned space by the discharged air.

The air conditioning unit according to a second aspect is an air conditioning unit according to the first aspect wherein the case has at least one intake duct on the bottom face. The air conditioning unit further includes a second moveable panel for opening and closing the intake duct. The moveable panel actuating mechanism opens and closes the first moveable panel and the second moveable panel.

According to this aspect, since the unit further includes a second moveable panel that opens and closes the intake duct on the bottom face of the case, and the moveable panel actuating mechanism opens and closes the first moveable panel and the second moveable panel, by closing off both the intake duct and the discharge duct with the first moveable panel and the second moveable panel when the air conditioning unit is not in operation, it will be possible to conceal the discharge duct and the intake duct from view from inside the air-conditioned space, so that visual appeal will be further improved.

The air conditioning unit according to a third aspect is an air conditioning unit according to the first aspect wherein at the second position, the first moveable panel is inclined downward by 0 to 45° with respect to the surface of the ceiling of the air-conditioned space.

According to this aspect, at the second position the first moveable panel is inclined downward by 0 to 45° with respect to the surface of the ceiling of the air-conditioned space; therefore, it will be possible to more effectively reduce smudging of the ceiling by discharged air.

The air conditioning unit according to a fourth aspect is an air conditioning unit according to the third aspect wherein at the second position, the first moveable panel is inclined downward by 20 to 30° with respect to the surface of the ceiling of the air-conditioned space.

According to this aspect, at the second position the first moveable panel is inclined downward by 20 to 30° with respect to the surface of the ceiling of the air-conditioned space; therefore, it will be possible to more effectively reduce smudging of the ceiling by discharged air.

The air conditioning unit according to a fifth aspect is an air conditioning unit according to the first aspect wherein the first moveable panel has a width equivalent to 0.25 to 1.0 times the width of the discharge duct.

According to this aspect, the first moveable panel has a width equivalent to 0.25 to 1.0 times the width of the discharge duct, with the first moveable panel at the first position closing off at least the outside section of the discharge duct at times that the air conditioning unit is not in operation; therefore, the discharge duct will not be readily visible from inside the room, making it possible to more effectively improve visual appeal. Moreover, when the air conditioning unit is running, the first moveable panel at the second position reduce discharging of air towards the ceiling, thus making it possible to more effectively reduce smudging of the ceiling of the air conditioned space by the discharged air.

The air conditioning unit according to a sixth aspect is an air conditioning unit according to any of the first to fifth aspects wherein the moveable panel actuating mechanism rotatably moves the first moveable panel between a first position and a second position.

According to this aspect, the moveable panel actuating mechanism rotatably moves the first moveable panel between the first position and the second position; therefore, it will be possible for reciprocating motion of the first moveable panel between the first position and the second position to take place reliably, through a simple mechanism.

The air conditioning unit according to a seventh aspect is an air conditioning unit according to any of the first to fifth aspects wherein the moveable panel actuating mechanism slidably moves the first moveable panel between a first position and a second position.

According to this aspect, the moveable panel actuating mechanism slides the first moveable panel between the first position and the second position; therefore, it will be possible for reciprocating motion of the first moveable panel between the first position and the second position to take place reliably, through a simple mechanism.

The air conditioning unit according to an eighth aspect is an air conditioning unit according to any of the first to seventh aspects wherein the first moveable panel has a shape such that, at the second position, the angle of incline of end sections with respect to the ceiling face of the air-conditioned space is greater than the angle of incline of a center section.

According to this aspect, the first moveable panel has a shape such that, at the second position, the angle of incline of the end sections with respect to the ceiling surface of the air-conditioned space is greater than the angle of incline of the center section; therefore, it will be possible to more effectively reduce smudging of the ceiling in proximity to the two ends of the discharge duct.

The air conditioning unit according to a ninth aspect is an air conditioning unit according to any of the first to seventh aspects wherein the first moveable panel has shapes such that a width of the center section is greater than a width of the end sections.

According to this aspect, the first moveable panel has a shape such that the width of the center section is greater than the width of the end sections; therefore, it will be possible to more effectively reduce smudging of the ceiling in proximity to the center of the discharge duct.

The air conditioning unit according to a tenth aspect is an air conditioning unit according to any of the first to seventh aspects wherein the first moveable panel has shapes such that, at the second position, the end sections are spaced further away from the ceiling face of the air-conditioned space than is the center section.

According to this aspect, the first moveable panel has a shape such that, at the second position, the end sections are spaced further away from the ceiling surface of the air-conditioned space than is the center section; therefore, it will be possible to more effectively reduce smudging of the ceiling in proximity to the two ends of the discharge duct. Additionally, since the first moveable panel in the closed state will appear to be recessed into the ceiling, visual appeal can be further improved.

The air conditioning unit according to an eleventh aspect is an air conditioning unit according to any of the first to seventh aspects wherein the first moveable panel has shapes such that a thickness of the end sections is greater than a thickness of the center section.

According to this aspect, the first moveable panel has a shape such that thickness of the end sections is greater than thickness of the center section; therefore, it will be possible to more effectively reduce smudging of the ceiling in proximity to the two ends of the discharge duct. Additionally, since the first moveable panel in the closed state will appear to be recessed into the ceiling, visual appeal can be further improved.

The air conditioning unit according to a twelfth aspect is an air conditioning unit according to any of the first to seventh aspects wherein the first moveable panel has a combination of at least two or more shapes selected from the group comprising: (a) a shape such that, at the second position, the angle of incline of the end sections with respect to the ceiling face of the air-conditioned space is greater than the angle of incline of the center section; (b) a shape such that the width of the center section is greater than the width of the end sections; (c) a shape such that, at the second position, the end sections are spaced further away from the ceiling face of the air-conditioned space than is the center section; and (d) a shape such that the thickness of the end sections is greater than the thickness of the center section.

According to this aspect, the first moveable panel has a combination of two or more shapes selected from the group comprising: (a) a shape such that, at the second position, the angle of incline of the end sections with respect to the ceiling surface of the air-conditioned space is greater than the angle of incline of the center section; (b) a shape such that the width of the center section is greater than the width of the end sections; (c) a shape such that, at the second position, the end sections are spaced further away from the ceiling surface of the air-conditioned space than is the center section; and (d) a shape such that thickness of the end sections is greater than thickness of the center section. Therefore, it will be possible to more effectively reduce smudging of the ceiling through various combinations of these shapes.

Effects of the Invention

According to the first aspect, the visual appeal of the air conditioning unit in the non-operational state is improved. Moreover, during running of the air conditioning unit it will be possible to reduce smudging of the ceiling of the air-conditioned space by the discharged air.

According to the second aspect, it is possible for the discharge duct and the intake duct to be concealed from view from the air-conditioned space, thus further improving visual appeal.

According to the third aspect, it is possible to effectively reduce smudging of the ceiling by discharged air.

According to the fourth aspect, it is possible to more effectively reduce smudging of the ceiling by discharged air.

According to the fifth aspect, the visual appeal of the air conditioning unit in the non-operational state is improved. At the same time, the range of possible smudging of the ceiling surface during operation can be covered sufficiently, and it will be possible to effectively inhibit the discharged air from smudging the ceiling of the air-conditioned space.

According to the sixth aspect, with a simple mechanism the first moveable panel can reliably be moved in a reciprocating motion between the first position and the second position.

According to the seventh aspect, with a simple mechanism the first moveable panel can reliably be moved in a reciprocating motion between the first position and the second position.

According to the eighth aspect, it is possible to more effectively reduce smudging of the ceiling in the vicinity of the end sections of the discharge duct.

According to the ninth aspect, it is possible to more effectively reduce smudging of the ceiling in the vicinity of the center section of the discharge duct.

According to the tenth aspect, it is possible to more effectively reduce smudging of the ceiling in the vicinity of the end sections of the discharge duct. Moreover, since in the closed state the first moveable panel will appear to be recessed into the ceiling, visual appeal is further improved.

According to the eleventh aspect, it is possible to more effectively reduce smudging of the ceiling in the vicinity of the end sections of the discharge duct. Moreover, since in the closed state the first moveable panel will appear to be recessed into the ceiling, visual appeal is further improved.

According to the twelfth aspect, it is possible to further effectively reduce smudging of the ceiling.

DETAILED DESCRIPTION OF THE INVENTION

Embodiment

Figure 1:
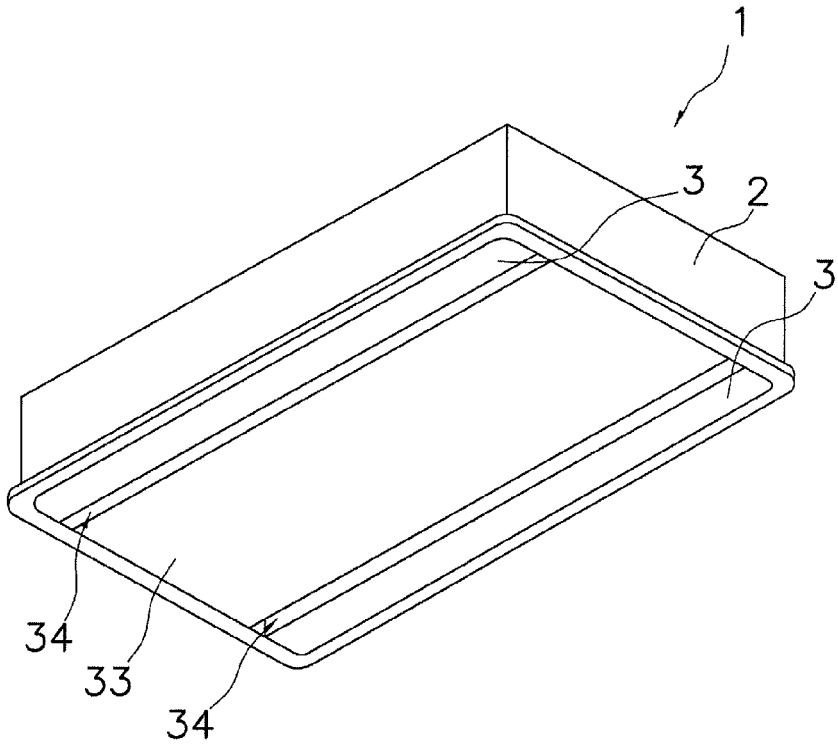
FIG. 1 is an exterior perspective view showing a first moveable panel of an air conditioning unit of a ceiling-mounted design according to an embodiment of the present invention, shown in the closed state.
Figure 2:
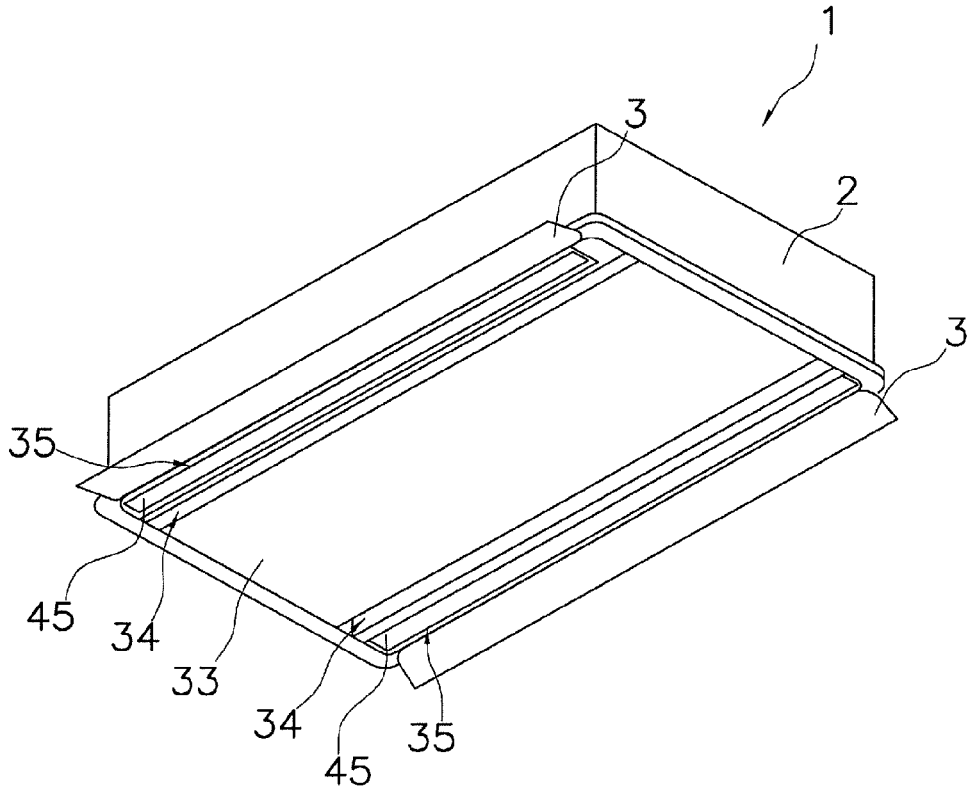
FIG. 2 is an exterior perspective view showing the first moveable panel of the air conditioning unit of FIG. 1, shown in the open state.

Basic Configuration of Air Conditioning Unit 1

The ceiling-disposed air conditioning unit 1 according to an embodiment of the present invention, shown in FIGS. 1 to 5, is installed so as to be recessed into the ceiling C (see FIG. 3) above a room or other air-conditioned space. The air conditioning unit 1 is mainly composed of a case 2, first moveable panels 3, a moveable panel actuating mechanism 4 (see FIG. 5), a blower fan 5, a heat exchanger 6, a drain pan 7, and a bellmouth 8.

Figure 3:
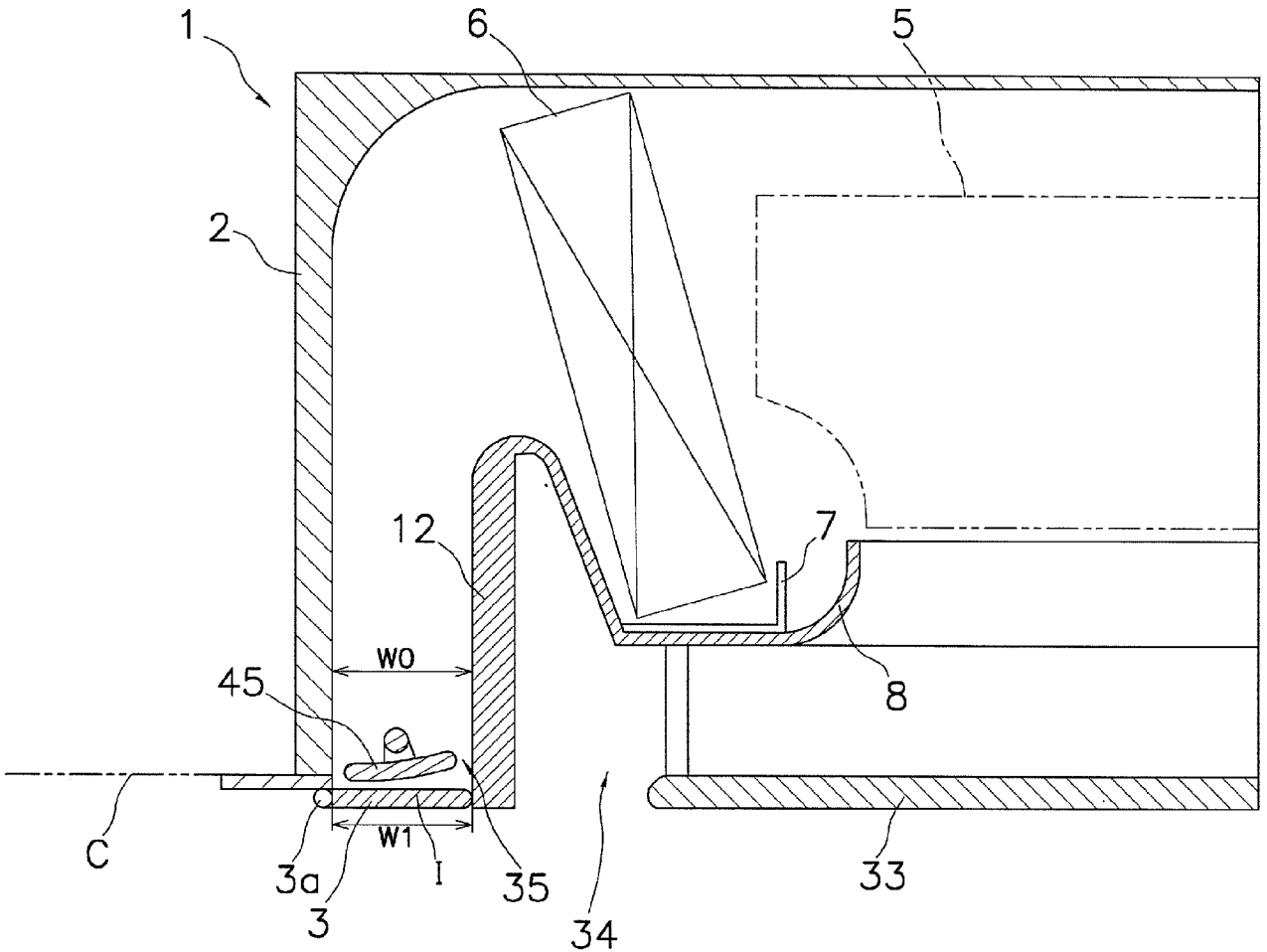
FIG. 3 is an enlarged sectional view of the vicinity of the first moveable panel in a first position of the air conditioning unit of FIG. 1.
Figure 4:
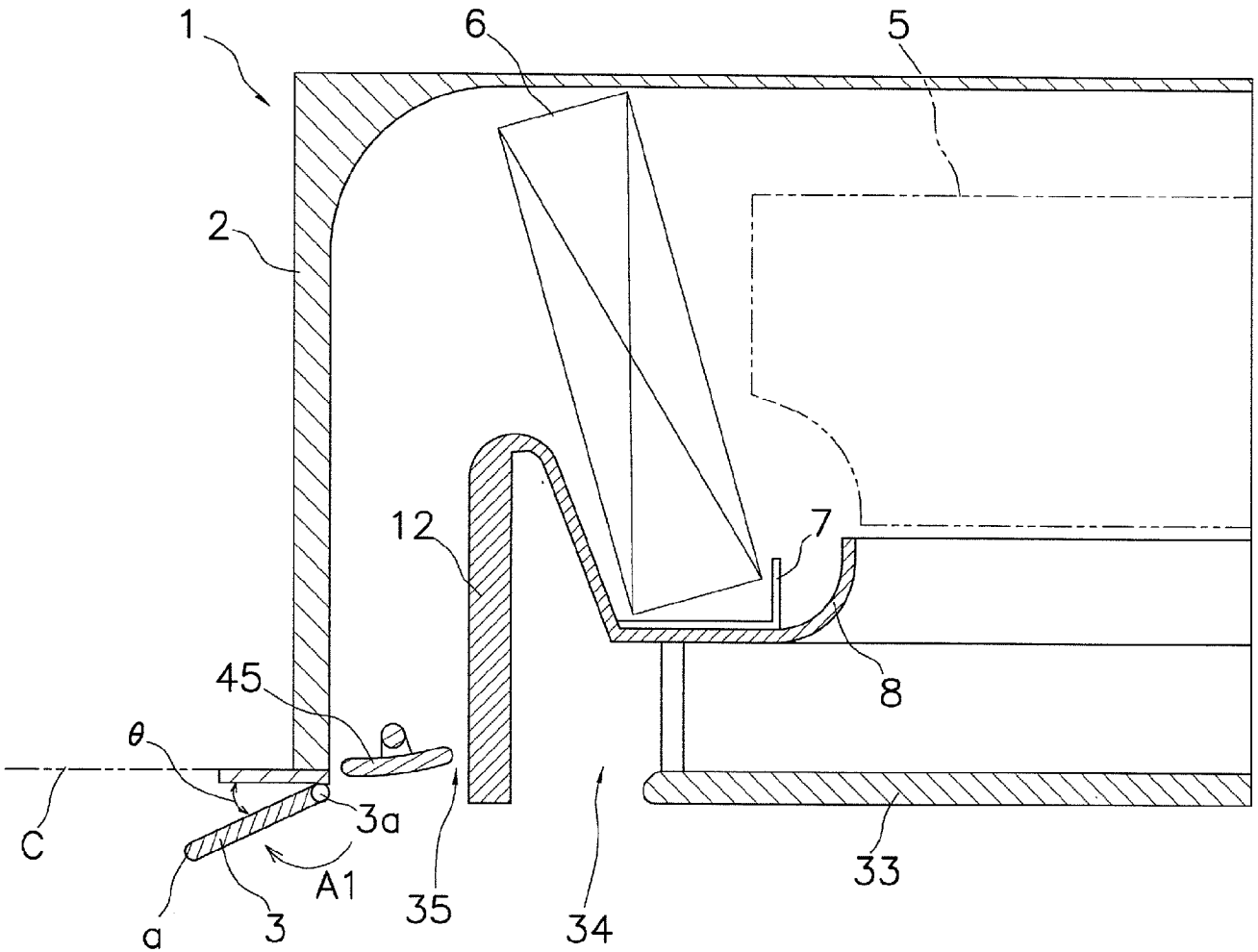
FIG. 4 is an enlarged sectional view of the vicinity of the first moveable panel in a second position of the air conditioning unit of FIG. 1.

As shown in FIG. 3 which shows the air conditioning unit 1 in simplified side sectional view, the case 2 is installed by being inserted into an duct formed in the ceiling C of the room, for example. The case 2 mainly houses the blower fan 5, which draws indoor air into the case 2 and discharges the air towards the outside peripheral direction; and the heat exchanger 6 which is situated so as to surround the peripheral part of the blower fan 5.

In the air conditioning unit 1 shown in FIG. 3, the case 2 has been installed fitting into the duct in the ceiling C. The case 2 can also be suspended from the surface of the ceiling C.

As shown in FIGS. 1 to 4, a flat panel 33, which is a flat bottom face panel constituting the bottom face of the case 2, is disposed in the center of the bottom face of the case 2. A pair of intake ducts 34 for drawing in air from the room is formed to either side of flat panel 33. To the outside of the pair of intake ducts 34 are formed a pair of discharge ducts 35 for discharging conditioned air from the case 2 back into the room. The discharge duct 35 has a flap 45 for adjusting the angle of discharge of the conditioned air.

Each of the pair of moveable panels 3 is a plate-shaped member made of material such as synthetic resin; as shown in FIGS. 1 to 4, they are positioned to either side of the flat panel 33. The first moveable panels 3 open and close the discharge ducts 35. The moveable panel actuating mechanism 4, discussed later, transfers the first moveable panels 3 between a first position I shown in FIG. 3 at which the first moveable panels 3 close off the discharge ducts 35, and a second position II shown in FIG. 4 at which the first moveable panels 3 open up the discharge ducts 35. At the first position I, the first moveable panels 3 will be oriented parallel with the ceiling C. On the other hand, at the second position II, the first moveable panels 3 open towards the outside of the discharge ducts 35 (the side closer to the ceiling C face).

The first moveable panels 3 have width W1 equivalent to 0.25 to 1.0 times the width W0 of the discharge ducts 35.

At the second position II, the first moveable panels 3 will be inclined downward by 0 to 45°, preferably downward by 20 to 30°, with respect to the plane of the ceiling C of the room.

The blower fan 5 is composed of a centrifugal fan such as a turbo fan. As shown in FIG. 3, air inside the room is drawn into the case 2 through the intake ducts 34, and conditioned air is discharged from the discharge ducts 35, creating air flow. The air drawn in through the intake ducts 34 flows through the bellmouth 8 and the blower fan 5 and into the heat exchanger 6. In the heat exchanger 6, the air is cooled or heated by heat exchange with a coolant, producing conditioned air. The conditioned air then flows along the inside face of the case 2 and is then discharged from the discharge ducts 35 into the room or other air-conditioned space.

As shown in FIG. 3, the drain pan 7, which is adapted to collect drain water formed by condensation of moisture in the air in the heat exchanger 6, is positioned to the lower side of the heat exchanger 6.

Configuration of Moveable Panel Actuating Mechanism 4

Figure 5:
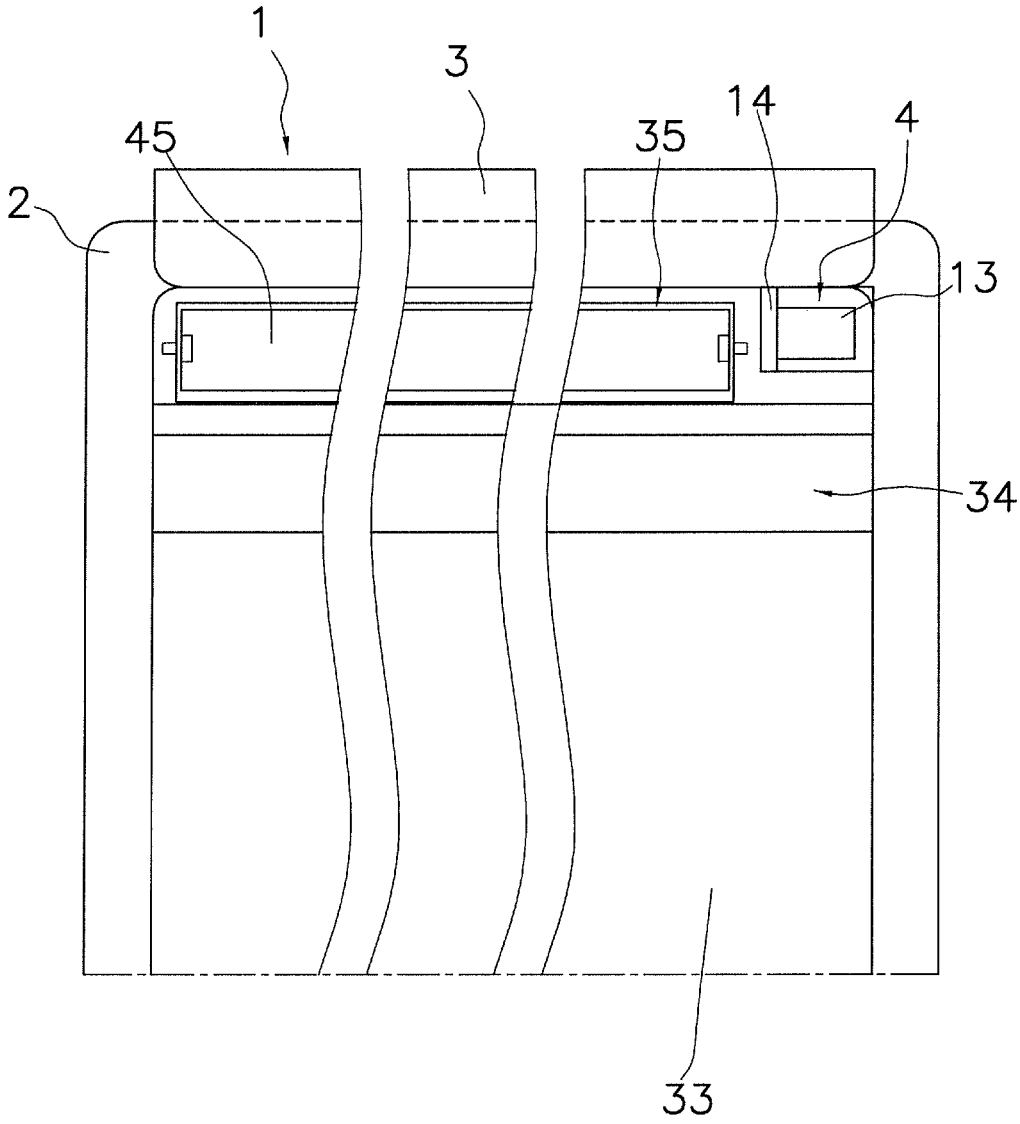
FIG. 5 is an illustration, viewed from below, of the first moveable panel of the air conditioning unit of FIG. 1 in the open state.

As shown in FIG. 5, the moveable panel actuating mechanism 4 is a mechanism for transferring the first moveable panels 3 between the first position I and the second position II. The moveable panel actuating mechanism 4 is composed, for example, of a step motor 13, and a drive power transmission mechanism 14 that transmits the drive power of the step motor 13 to the first moveable panels 3. As the drive power transmission mechanism 14 it would be possible to employ a mechanism for transmitting rotary drive power of the step motor 13 to a rotating shaft 3*a* of the first moveable panel 3, or the like with reducing speed.

When operation of the air conditioning unit 1 is started, the moveable panel actuating mechanism 4 rotate the first moveable panels 3 from the first position to the second position, at which the first moveable panels 3 will incline downward by a determined angle θ with respect to the ceiling C and open the discharge ducts 35. On the other hand, when operation of the air conditioning unit 1 is stopped, the first moveable panels 3 will rotate from the second position to the first position, and close off the discharge ducts 35.

Characteristics of the Embodiment (1)

The ceiling-embedded air conditioning unit 1 of the embodiment includes the first moveable panels 3 that open and close the discharge ducts 35; and the moveable panel actuating mechanism 4 that transfers the first moveable panels 3 between the first position I in which the first moveable panels 3 close off the discharge ducts 35, and the second position II in which the first moveable panels 3 are opened to the outside of the discharge ducts 35.

Consequently, with the air conditioning unit 1 stopped, the first moveable panels 3 will close off the discharge ducts 35 in the first position I and prevent the discharge ducts 35 from being visible from inside the room, thus making it possible for the bottom face of the case 2 of the air conditioning unit 1 to be aligned with the ceiling surface and improving the visual appeal of the air conditioning unit 1 when stopped.

Moreover, when the air conditioning unit 1 is running, the first moveable panels 3 will transfer to the outside of the discharge ducts 35, i.e. to the second position II opened out closer towards the plane of the ceiling C of the air-conditioned space, thus making it possible to reduce smudging of the ceiling C of the air-conditioned space by the discharged air.

(2)

In the air conditioning unit 1 of the embodiment, at the second position II the first moveable panels 3 are inclined downward by 0 to 45° with respect to the plane of the ceiling C of the air-conditioned space, thus making it possible to effectively reduce smudging of the ceiling C by the discharged air.

(3)

In the air conditioning unit 1 of the embodiment, at the second position II the first moveable panels 3 are inclined downward by 20 to 30° with respect to the plane of the ceiling C of the air-conditioned space, thus making it possible to more effectively reduce smudging of the ceiling C by the discharged air.

(4)

In the air conditioning unit 1 of the embodiment, the moveable panel actuating mechanism 4 transfers the first moveable panels 3 between the first position I and the second position II, making it possible for reciprocating motion of the first moveable panels 3 between the first position I and the second position II to take place reliably through a simple mechanism.

(5)

In the first moveable panels 3 of the air conditioning unit 1 of the embodiment, the first moveable panels 3 have a width W1 equivalent to 0.25 to 1.0 times the a width W0 of the discharge ducts 35, and thus when the air conditioning unit 1 is stopped, the first moveable panels 3 in the first position I will close off at least the outside section of the discharge ducts 35 so that the ducts 35 are substantially invisible from inside the room, thereby improving visual appeal in the non-operational state.

Furthermore, when the air conditioning unit 1 is running, it is possible for the first moveable panels 3 in the second position II to reduce discharge of air towards the ceiling C, thus making it possible to more effectively reduce smudging of the ceiling C of the air-conditioned space by the discharged air.

Modification of the Embodiment (A)

In the air conditioning unit 1 of the embodiment, only the discharge ducts 35 are opened and closed by the first moveable panels 3. However, no limitation of the invention is implied thereby, and by way of a modification of the present invention, shown in FIGS. 6 (*a*) and (*b*), there can be further provided second moveable panels 9 that open and close the intake ducts 34 on the bottom face of the case 2, with the moveable panel actuating mechanism 4 opening and closing both the first moveable panels 3 and the second moveable panels 9.

Figure 6A:
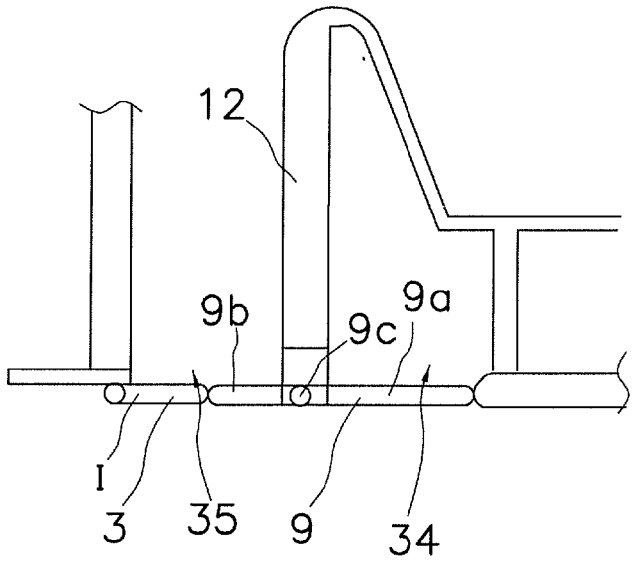
FIG. 6 is an operational illustration of a first moveable panel and a second moveable panel according to a modification of the embodiment of the present invention, wherein (a) shows the closed state and (b) shows the open state.
Figure 6B:
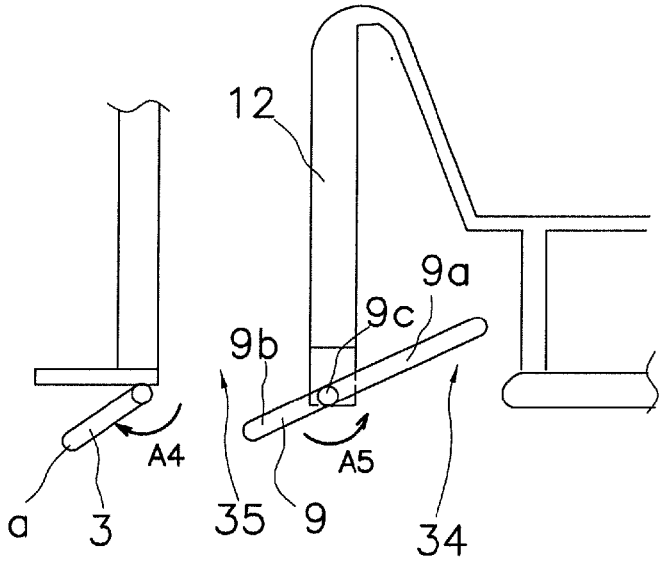

In this case, when the air conditioning unit 1 shown in FIG. 6 (*a*) is stopped, both the intake ducts 34 and the discharge ducts 35 will be closed off by the first moveable panels 3 and the second moveable panels 9, so that not only the discharge ducts 35 but also the intake ducts 34 will be concealed from view from inside the room, making it possible for the bottom face of the case 2 of the air conditioning unit 1 to have an "all-flat" configuration that matches the ceiling surface, further improving visual appeal.

Moreover, the second moveable panels 9 shown in FIGS. 6 (*a*) and (*b*) have an intake duct opening/closing portion 9*a*, a discharge duct opening/closing portion 9*b*, and a rotating shaft 9*c*. The rotating shaft 9*c* is rotatably linked to a support portion 12 inside the case 2. The discharge ducts 35 are opened and closed by the discharge duct opening/closing portions 9*b* and the first moveable panels 3. In this case, the width of the first moveable panels 3 will be set to 0.25 to 0.75 times (preferably to 0.5 times) the width of the discharge ducts 35.

Consequently, as shown in FIG. 6 (*b*), with the first moveable panels 3 and the second moveable panels 9 rotated respectively in the direction of arrows A4 and A5 and opened to a determined angle under the driving power of the moveable panel actuating mechanism 4, the air discharged from the discharge ducts 35 will travel along a flow path that is regulated by both the discharge duct opening/closing portions 9*b* and the first moveable panels 3. As a result, it will be possible to more reliably reduce smudging of the ceiling C.

(B)

In the air conditioning unit 1 of the embodiment, the discharge ducts 35 are opened and closed through rotating of the first moveable panels 3. However, no limitation of the invention is implied thereby, and by way of another modification of the present invention, shown in FIGS. 7 (*a*) and (*b*), the moveable panel actuating mechanism 4 can slide the first moveable panels 3 between the first position I and the second position II in the direction of the arrow A6 or in the opposite direction. In this case as well, it will be possible to reliably bring about reciprocating motion of the first moveable panels 3 between the first position I and the second position II, through a simple mechanism.

Figure 7A:
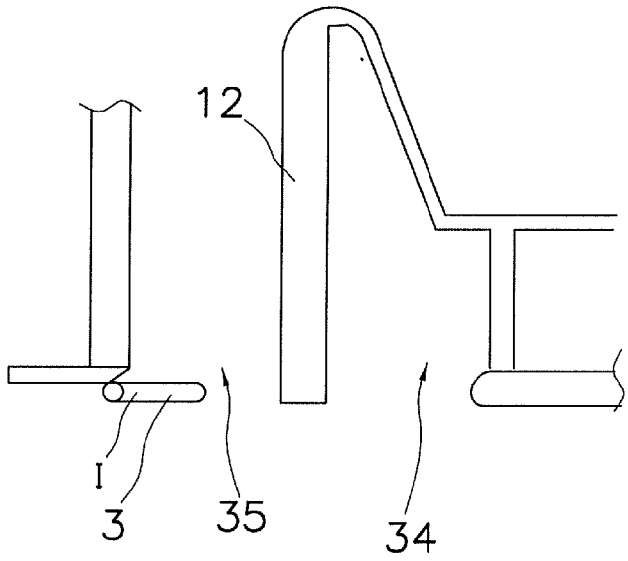
FIG. 7 is an operational illustration of a first moveable panel of sliding design according to another modification of the embodiment of the present invention, wherein (a) shows the closed state and (b) shows the open state.
Figure 7B:
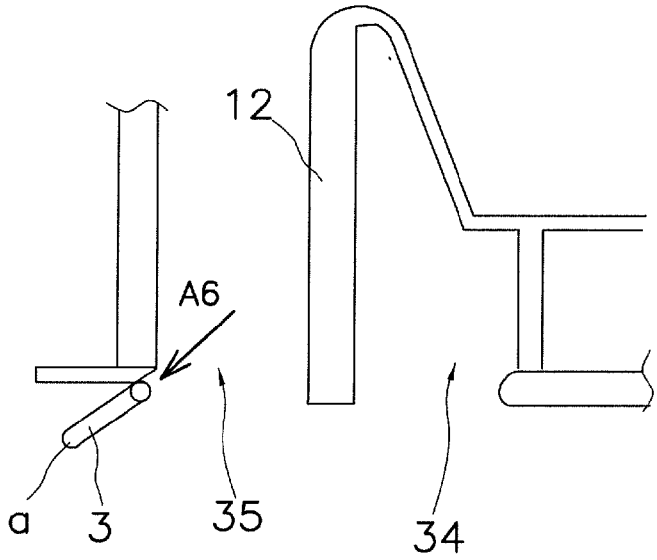

Here, in the first position I shown in FIG. 7 (*a*), the first moveable panels 3 will be oriented on the horizontal; when transferred to the second position II shown in FIG. 7 (*b*), the first moveable panels 3 will be inclined slightly, then be made sliding displacement in the direction of arrow A6 by the moveable panel actuating mechanism 4. Alternatively, the first moveable panels 3 may be slightly inclined at the first position I in advance.

As the moveable panel actuating mechanism 4 for slidably driving the first moveable panels 3 it would be possible to use a mechanism such as a combination of a rack and a pinion.

(C)

In the air conditioning unit 1 of the embodiment, the first moveable panels 3 are flat plate-shaped members; however, no limitation of the invention is implied thereby. The first moveable panels 3 shown in FIG. 8 (*a*) by way of another modification of the present invention can have shapes such that, in the second position II, the angle of incline θa of the end section 3*b* (see FIG. 8 (*b*)) with respect to the plane of the ceiling C of the air-conditioned space is greater than the angle of incline θb of the center section 3*c* (see FIG. 8 (*c*)).

In this case, it will be possible to more effectively reduce smudging of the ceiling C in proximity to the two ends 35*a*, 35*b* of the discharge ducts 35.

The angle of incline θa of the end section 3*b* is set to between 25 and 35° (preferably to 30°); and the angle of incline θb of the center section 3*c* is set to between 20 and 30° (preferably to 25°).

Figure 8A:
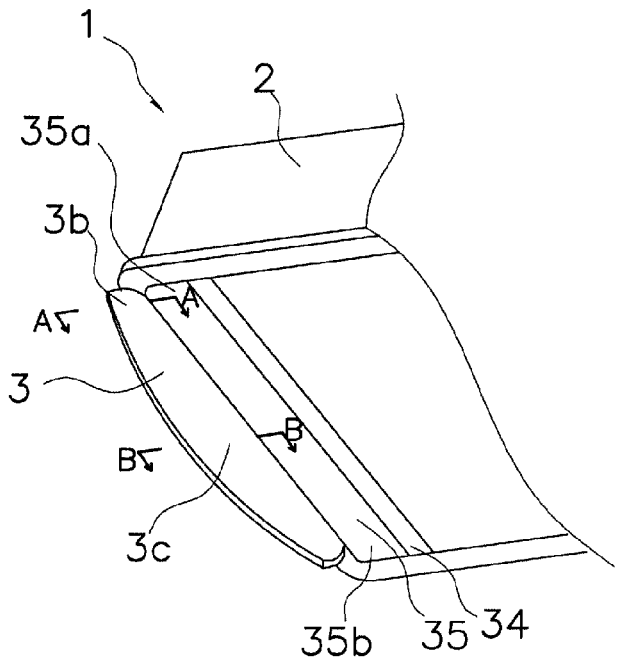
FIG. 8 is an illustration of a first moveable panel according to yet another modification of the embodiment of the present invention having a large angle of incline on end sections, wherein (a) shows the open state viewed from diagonally below, (b) is a sectional view taken along A-A, and (c) is a sectional view taken along B-B.
Figure 8B:
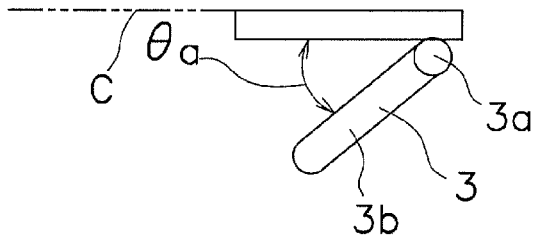
Figure 8C:
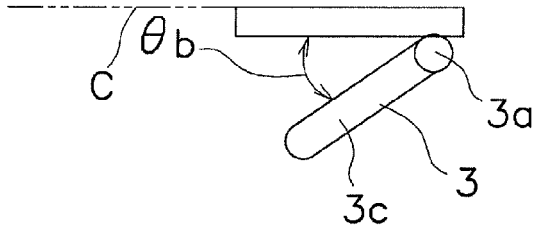

Even if the first moveable panels 3 have shapes with partial variation in the angle of incline only in proximity to the ends, instead of the shapes having a gradually changing angle of incline from the center towards the ends as shown in FIG. 8 (*a*) to (*c*), it will be possible nevertheless to more effectively reduce smudging of the ceiling C in proximity to the two ends 35*a*, 35*b* of the discharge ducts 35.

(D)

Figure 9:
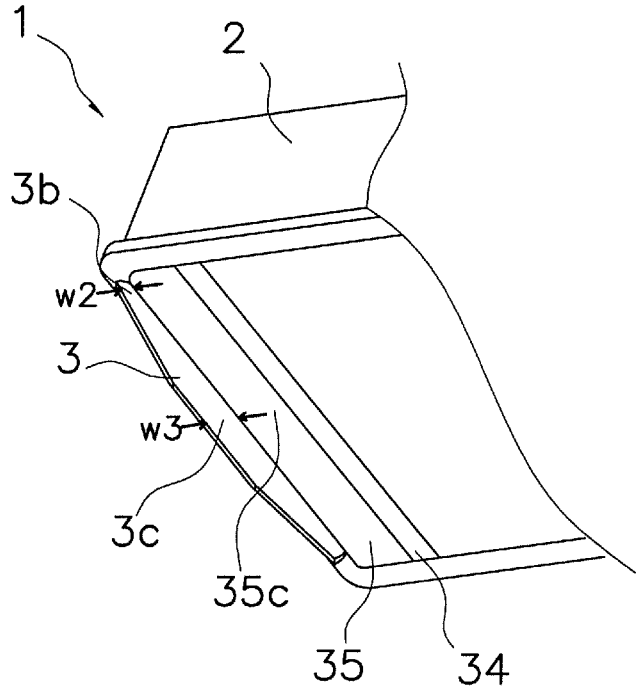
FIG. 9 is an illustration of a first moveable panel according to yet another modification of the embodiment of the present invention having large width in the center section, and shows the open state viewed from diagonally below.

In the air conditioning unit 1 of the embodiment, the first moveable panels 3 are rectangular plate-shaped members; however, no limitation of the invention is implied thereby. By way of another modification of the present invention, the first moveable panels 3 shown in FIG. 9 may have shapes such that the width W3 in the center section 3*c* is greater than the width W2 at the end sections 3*b*.

In this case, it will be possible to more effectively reduce smudging of the ceiling C in proximity to the center section 35*c* of the discharge ducts 35.

(E)

In the air conditioning unit 1 of the embodiment, the first moveable panels 3 are flat plate-shaped members; however, no limitation of the invention is implied thereby. By way of another modification of the present invention, the first moveable panels 3 shown in FIGS. 10 (*a*) to (*c*) may have a shape such that, in the second position II, the end sections 3*b* are spaced further away from the surface of the ceiling C than is the center section 3*c*.

Figure 10A:
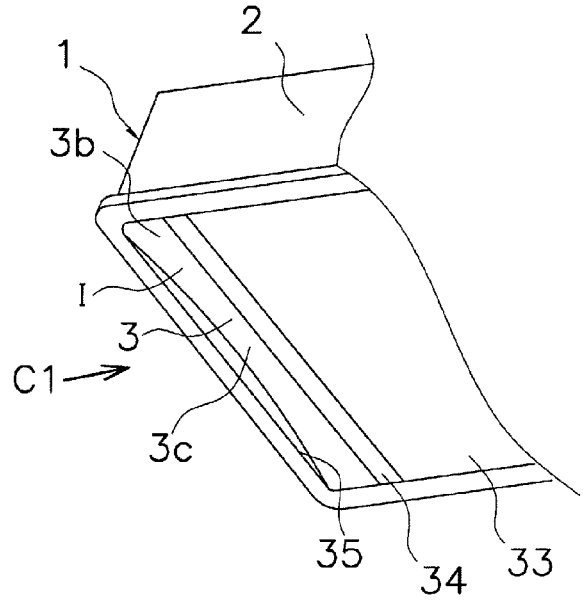
FIG. 10 is an illustration of a first moveable panel according to yet another modification of the embodiment of the present invention having end sections spaced away from the ceiling, wherein (a) shows the closed state viewed from diagonally below, (b) shows the open state viewed from diagonally below, and (c) shows a view of parts of (a) and (b) seen from the direction of arrow C1.
Figure 10B:
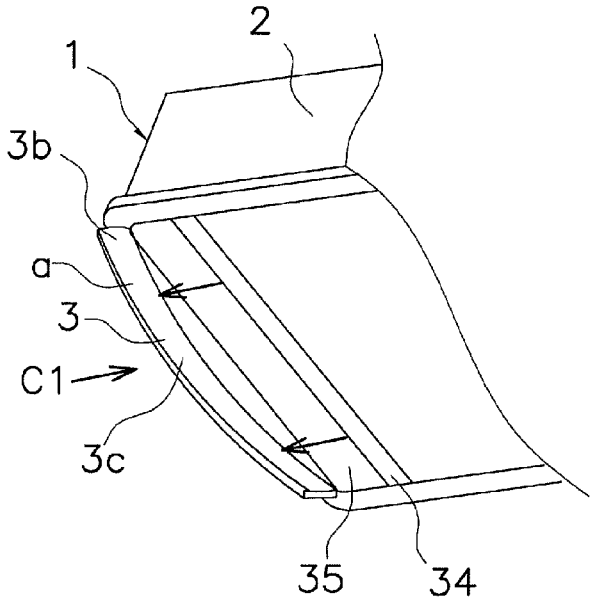
Figure 10C:
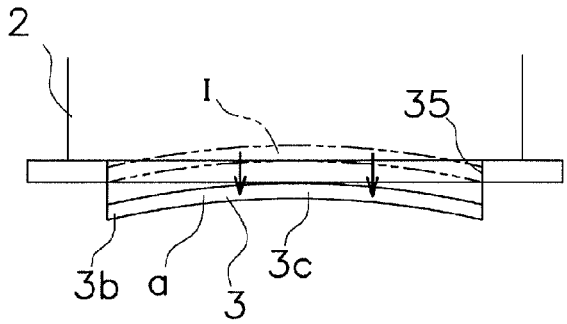

In this case, with the first moveable panels 3 in the open second position II (see FIGS. 10 (*b*) and (*c*)), it will be possible to more effectively reduce smudging of the ceiling C in proximity to the two ends 3*b* of the discharge ducts 35.

Moreover, with the first moveable panels 3 in the closed first position I (see FIGS. 10 (*a*) and (*c*)), the first moveable panels 3 will appear to be recessed in from the ceiling C or the flat panel 33, thus further improving visual appeal of the air conditioning unit 1.

By the drive power of the moveable panel actuating mechanism 4, the first moveable panels 3 are made sliding displacement between the closed state at the first position I shown in FIG. 10 (*a*), and the open state at the second position II shown in FIG. 10 (*b*). As the moveable panel actuating mechanism 4 for sliding the first moveable panels 3 it would be possible to use a mechanism such as a combination of a rack and a pinion.

(F)

In the air conditioning unit 1 of the embodiment, the first moveable panels 3 are flat plate-shaped members; however, no limitation of the present invention is implied thereby. By way of another modification of the present invention, the first moveable panels 3 shown in FIG. 11 (*a*) to (*c*) may have a shape such that thickness of the end sections 3*b* is greater than thickness of the center section 3*c*.

Figure 11A:
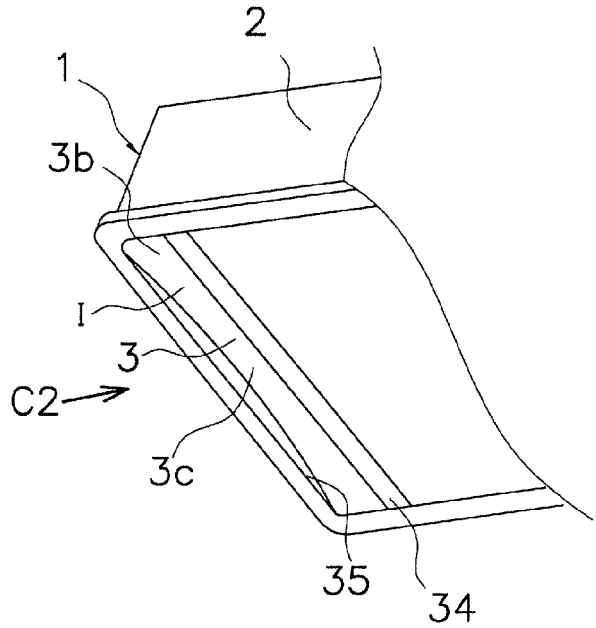
FIG. 11 is an illustration of a first moveable panel according to yet another modification of the embodiment of the present invention having thick end sections, wherein (a) shows the closed state viewed from diagonally below, (b) shows the open state viewed from diagonally below, and (c) is a view of parts of (a) and (b) seen from the direction of arrow C2.
Figure 11B:
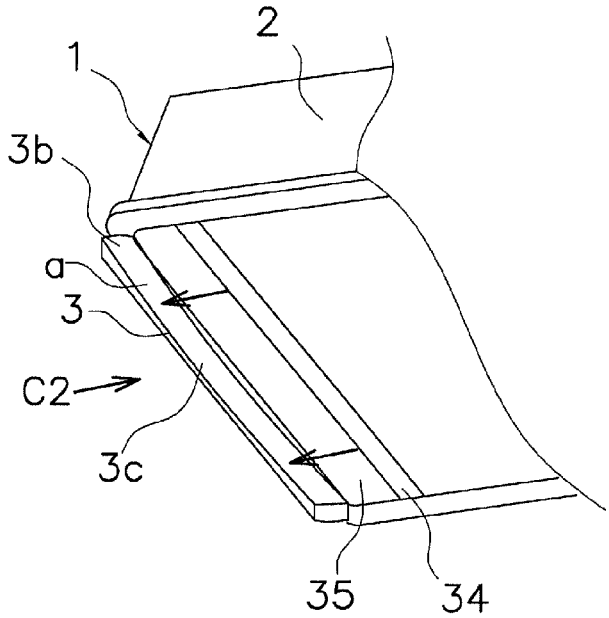
Figure 11C:
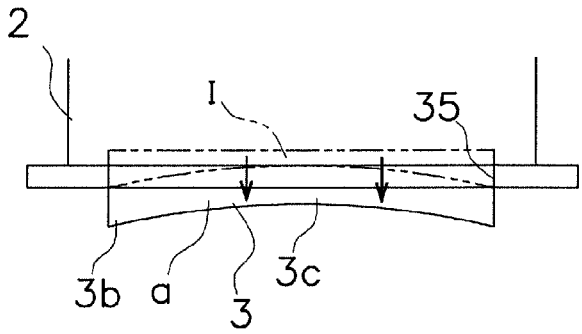

In this case, as in modification (E) above, with the first moveable panels 3 opened to the second position II (see FIGS. 11 (*b*) and (*c*)), it will be possible to more effectively reduce smudging of the ceiling C in proximity to the two ends 3*b* of the discharge ducts 35.

Moreover, with the first moveable panels 3 in the closed state at the first position I (see FIGS. 11 (*a*) and (*c*)), the first moveable panels 3 will appear recessed in from the ceiling C or the flat panel 33, thus further improving visual appeal of the air conditioning unit 1.

By the drive power of the moveable panel actuating mechanism 4, the first moveable panels 3 are made sliding displacement between the closed state at the first position I shown in FIG. 11 (*a*), and the open state at the second position II shown in FIG. 11 (*b*). As the moveable panel actuating mechanism 4 for sliding the first moveable panels 3 it would be possible to use a mechanism such as a combination of a rack and a pinion.

(G)

As yet another modification of the present invention, the first moveable panels 3 may have a combination of at least two or more shapes selected from the group comprising the four shapes mentioned above, namely: (a) a shape such that at the second position II the angle of incline of the end sections 3*b* with respect to the ceiling C face of the air-conditioned space is greater than the angle of incline of the center section 3*c*; (b) a shape such that the width of the center section 3*c* is greater than the width of the end sections 3*b*; (c) a shape such that in the second position II the end sections 3*b* are spaced further away from the ceiling C face of the air-conditioned space than is the center section 3*c*; and (d) a shape such that thickness of the end sections 3*b* is greater than thickness of the center section 3*c*. In this case, it will be possible further effectively reduce smudging of the ceiling C by combinations of these shapes.

INDUSTRIAL APPLICABILITY

The present invention is broadly applicable to air conditioning units having a ceiling-installed design, equipped with discharge ducts on the bottom face of the case. Accordingly, the invention is applicable not only to air conditioning units of ceiling-embedded designs, but also to those of ceiling-suspended design.

What is claimed is:

1. A ceiling-disposed air conditioning unit configured to be disposed above a space to be air conditioned, the air conditioning unit comprising:

a case having an intake duct and at least one discharge duct on a bottom face, the discharge duct being formed to an outside of the intake duct;

a first moveable panel configured to open and close the discharge duct; and a moveable panel actuating mechanism configured to move the first moveable panel between a first position and a second position, the first moveable panel closing off at least an outside section of the discharge duct in the first position, and the first moveable panel opening the outside section of the discharge duct in the second position, the first moveable panel having an attachment end attached to the case at an attachment point, the discharge duct having a peripheral edge defining a periphery of the discharge duct, the peripheral edge having an outer section, an inner section and a pair of connecting section connecting the inner and outer sections, with the outer section being located further from the intake duct than the inner section and the connecting sections as measured along the bottom surface, and the attachment point being disposed at the outer section of the peripheral edge of the discharge duct, and a free end disposed inwardly of the attachment end and the outer section within the discharge duct in the first position as viewed along a direction perpendicular to the bottom face, with the free end moving outward to a position outwardly of the attachment point when the first moveable panel is moved from the first position to the second position so that the first movable panel is located outwardly of the discharge duct in the second position and does not overlap the discharge duct in the second position as viewed along the direction perpendicular to the bottom face; whereby the first moveable panel directs discharge air away from the ceiling in the second position.

2. The air conditioning unit as recited in claim 1, further comprising a second moveable panel configured to open and close the intake duct, the moveable panel actuating mechanism being further configured to move the second moveable panel between first and second positions with the first movable panel to open and close the intake duct.

3. The air conditioning unit as recited in claim 1, wherein the first moveable panel is inclined downward by less than 45° with respect to a surface of a ceiling of the air-conditioned space in the second position.

4. The air conditioning unit as recited in claim wherein the first moveable panel is inclined downward by 20 to 30° with respect to the surface of the ceiling of the air-conditioned space in the second position.

5. The air conditioning unit as recited in claim 1, wherein the first moveable panel has a width equivalent to 0.25 to 1.0 times a width of the discharge duct.

6. The air conditioning unit as recited in claim 1, wherein the moveable panel actuating mechanism is configured to rotatably move the first moveable panel between the first position and the second position.

7. The air conditioning unit as recited in claim 1, wherein the moveable panel actuating mechanism is configured to slidably move the first moveable panel between the first position and the second position.

8. The air conditioning unit as recited in claim 1, wherein the first moveable panel is shaped such that an angle of incline of end sections of the first movable panel with respect to a ceiling surface of the air-conditioned space is greater than an angle of incline of a center section of the first movable panel when the first movable panel is in the second position.

9. The air conditioning unit as recited in claim 1, wherein the first moveable panel is shaped such that a width of a center section of the first movable panel is greater than a width of end sections of the first movable panel.

10. The air conditioning unit as recited in claim 1, wherein the first moveable panel is shaped such that end sections of the first movable panel are spaced further away from a ceiling surface of the air-conditioned space than a center section of the first movable panel when the first movable panel is in the second position.

11. The air conditioning unit as recited in claim 1, wherein the first moveable panel is shaped such that a thickness of end sections of the first movable panel is greater than a thickness of a center section of the first movable panel.

* * * * *